US005454536A

United States Patent [19]

Melhuish

[11] Patent Number: 5,454,536

[45] Date of Patent: Oct. 3, 1995

[54] CHAIR BASE ASSEMBLY

[75] Inventor: Robert A. Melhuish, East Greenville, Pa.

[73] Assignee: Westinghouse Electric Corporation, Pittsburgh, Pa.

[21] Appl. No.: 182,815

[22] Filed: Jan. 13, 1994

[51] Int. Cl.[6] ..... A47B 91/00

[52] U.S. Cl. ..... 248/188.7; 248/415; 297/344.2

[58] Field of Search ..... 248/425, 188.7, 248/415, 188.8; 297/344.2

[56] References Cited

U.S. PATENT DOCUMENTS

| | | | |
|---|---|---|---|
| 4,598,892 | 7/1986 | Franckowiak et al. | 248/406 |
| 4,653,710 | 3/1987 | Dickison | 248/188 |
| 4,911,391 | 3/1990 | Ellis | 248/188.7 |
| 5,149,035 | 9/1992 | Bonnema et al. | 248/188.7 |
| 5,249,768 | 10/1993 | Edwards et al. | 248/188.7 |

FOREIGN PATENT DOCUMENTS

| | | |
|---|---|---|
| 0045152 | 2/1982 | European Pat. Off. . |
| 0357578 | 3/1990 | European Pat. Off. . |
| 9011709 | 10/1990 | WIPO . |

*Primary Examiner*—Ramon O. Ramirez

[57] ABSTRACT

Disclosed is a pedestal base for furniture, such a chair. The pedestal base is comprised of a plurality of radially oriented leg members which converge on a central hub, the hub and all of the leg members being formed as an integral piece of molded plastic. The central hub has an upper portion which is adapted to receive a plastic bushing and a lower molded portion which in combination with the bushing holds a chair seat height adjustment mechanism, such as a pneumatic cylinder. The chair base is lightweight and less expensive to manufacture than prior metal and wood chair bases.

4 Claims, 3 Drawing Sheets

CHAIR BASE ASSEMBLY

BACKGROUND OF THE INVENTION

This invention relates to a base assembly for furniture. It relates particularly to a pedestal type of chair base assembly where the base legs radiate from a central hub upon which the chair is supported.

For many years, pedestal type chair bases were made of metal or wood. In recent years, the metal or wood chair bases were often covered with a plastic or rubber sheathing to protect the base legs and improve their appearance. U.S. Pat. No. 5,249,768 to Edwards et al. is a recently issued patent directed to such a plastic sheathed metal chair base. Pedestal chair bases made of metal or wood were frequently heavy and usually used a heavy metal hub or sleeve to support the chair seat. Chairs using a heavy metal or wood base were difficult to move and expensive to construct.

SUMMARY OF THE INVENTION

It is therefore an object of this invention to provide a pedestal type of base for furniture, such as a chair, that is lightweight, attractive in appearance and relatively inexpensive to manufacture.

It is another object of this invention to provide a lightweight pedestal type of base for a chair which accommodates a pneumatic cylinder or other mechanism used to adjust the height of the chair seat.

It is a still further object of this invention to provide a pedestal type of base for a chair made entirely of lightweight reinforced plastic that can be easily adapted to many different types of chair designs.

It has been discovered that the foregoing objects can be attained by a base for supporting a chair comprising a plurality of radially oriented leg members which converge about a central cylindrical hub, the hub and all of the leg members being formed as an integral piece of molded plastic. The cylindrical hub has an upper portion that extends above the leg members and a lower portion that extends below the leg members where the leg members converge about the hub. The lower portion of the hub has an internal diameter smaller than the internal diameter of the upper portion of the hub and is adapted to receive and support a chair seat height adjustment mechanism, such as a pneumatic cylinder. The upper portion of the hub is fitted with a hollow cylindrical bushing that also receives and supports the seat height adjustment mechanism.

DESCRIPTION OF THE PREFERRED EMBODIMENT

Figure 1:
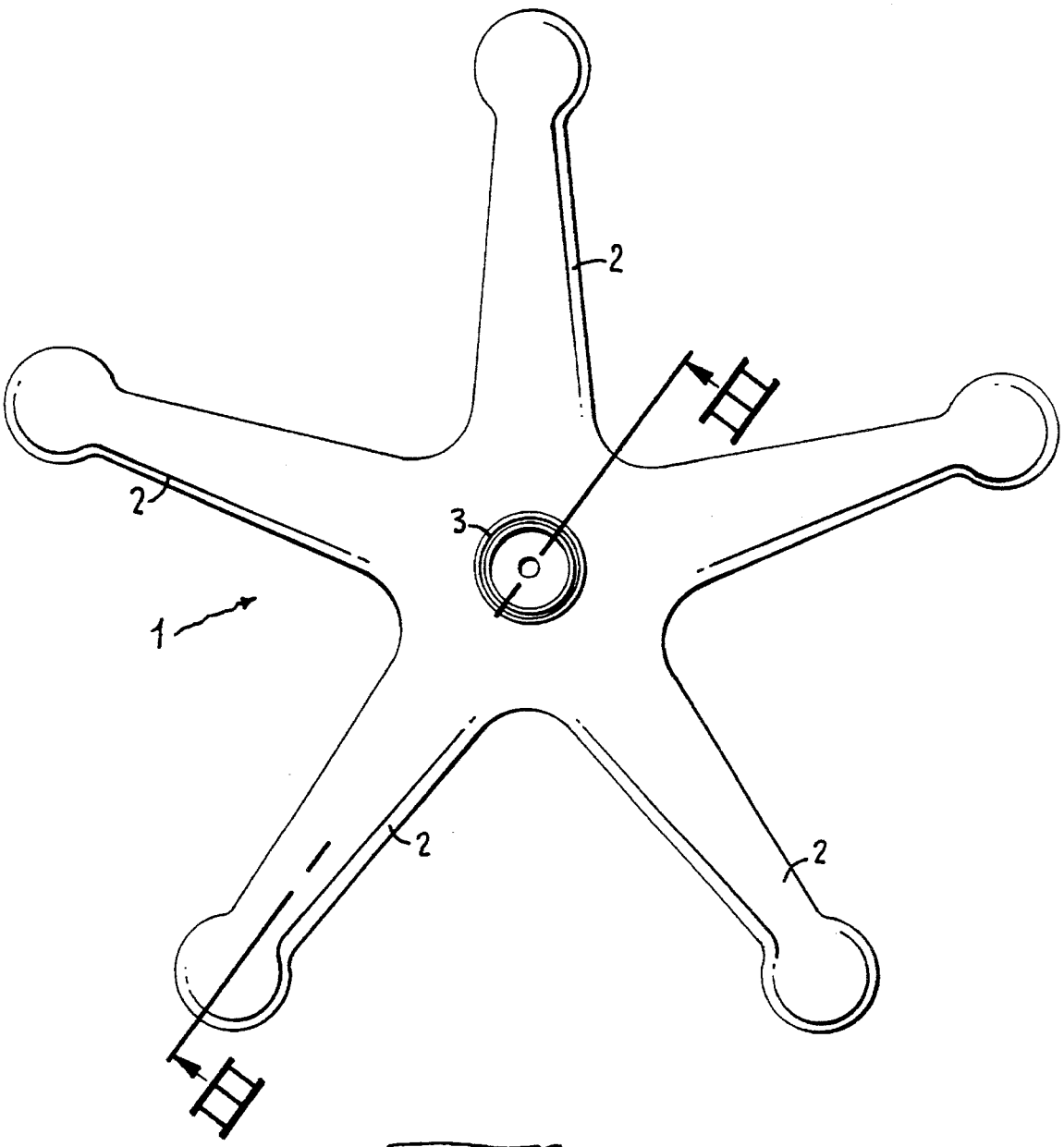
FIG. 1 is a top view of a preferred embodiment of the pedestal chair base made in accordance with this invention.
Figure 2:
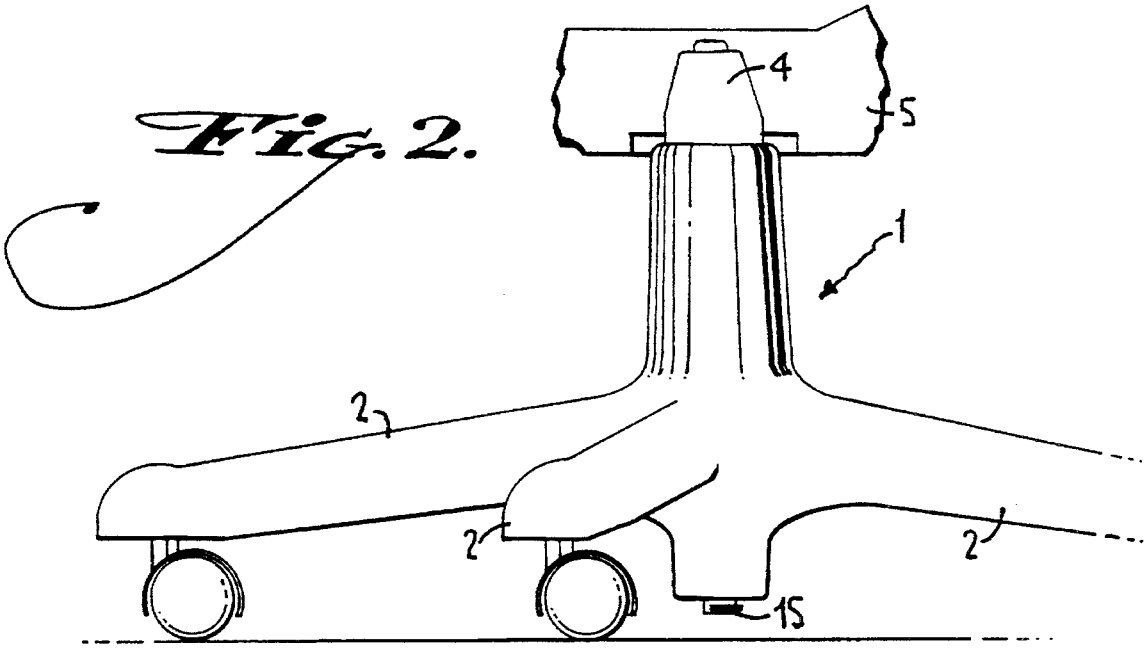
FIG. 2 is an elevational view, partly in section, of a preferred embodiment of the pedestal chair base made in accordance with this invention.

FIGS. 1–5 illustrate a preferred embodiment of a chair base 1 made in accordance with this invention. As shown in FIGS. 1 and 2, the base 1 is comprised of a plurality of radially oriented leg members 2. While FIG. 1 illustrates a base 1 having five radially oriented leg members 2, fewer or more leg members 2 may be used for the base 1 of this invention without departing from its scope. The leg members 2 converge and merge into a central hub 3 adapted to receive and support a columnar chair seat height adjustment and support mechanism 4 that is attached to the chair seat support and tilt housing 5.

As illustrated in FIGS. 1–4, all of the leg members 2 and central hub 3 are formed as an integral single piece of injection molded plastic. In this embodiment the preferred plastic was a 33% glass fiber filled nylon plastic sold under the tradename "Nypel" by Allied Signal Corporation, but a number of other reinforced structural plastics could be used if desired.

The central hub 3 has an upper portion 6 which extends above the leg members 2 and a lower portion 7 that extends below the leg members 2 where the leg members 2 converge about the hub 3. As best illustrated in FIG. 3, the lower portion 7 of the hub 3 has an internal diameter smaller than the internal diameter of the upper portion 6 of the hub 3 and is sized internally to receive a chair seat height adjustment and support mechanism, such as a pneumatic cylinder 4.

Figure 5:
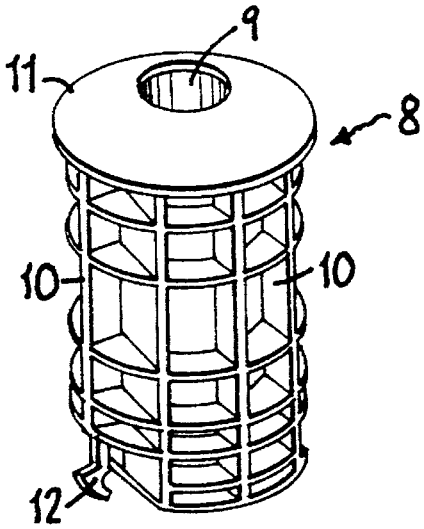
FIG. 5 is an isometric view of the plastic hub bushing used in a preferred embodiment of the pedestal chair base made in accordance with this invention.

The upper portion 6 of the central hub is fitted with a separate hollow cylindrical bushing 8, which is illustrated in FIG. 5. The bushing 8 is also molded of a dense structural plastic, such as "Delrin" and has an outer diameter that is the same or just slightly smaller than the internal diameter of the upper portion 6 of the hub 3. The hollow central opening 9 of the bushing 8 has an internal diameter that is substantially the same as the internal diameter of the lower portion 7 of the central hub 3. As shown in FIG. 5, the outer surface of the bushing 8 has a plurality of vertical and horizontal ribs 10 which stiffen the bushing and grip the interior wall surface of the upper portion 6 of the hub 3. The bushing 8 is also provided with a top flange 11 that is designed to fit over the top of the upper portion 6 of the hub 3. The bushing also is provided with a diametrically opposed pair of integral spring-like clips or tabs 12 that are adapted to fit within a pair of mating openings 13 formed at the juncture of the upper portion 6 and the lower portion 7 of the hub 3 and hold the bushing 8 firmly in place between the top flange 11 and the clips or tabs 12 when snapped into the openings 13, as illustrated in FIG. 3.

Figure 3:
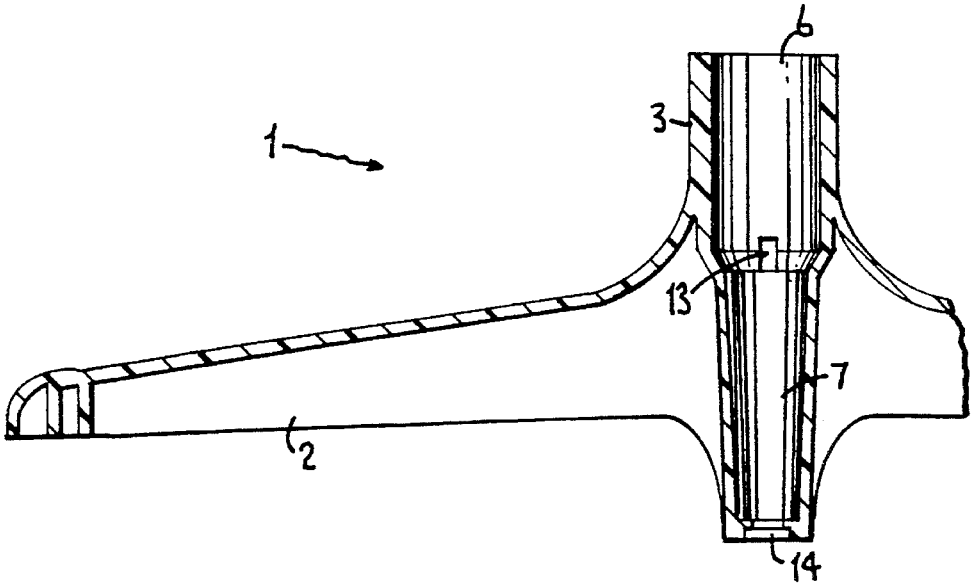
FIG. 3 is a sectional view taken along Section lines III—III shown in FIG. 1.

As illustrated in FIG. 3, the lower end of the chair seat height adjustment mechanism, which in this embodiment is a pneumatic cylinder 4, fits within an opening 14 in the bottom or base of the lower portion 7 of the hub 3 and the cylinder 4 is retained therein by an external retaining clip 15 that fits into a circumferential groove on the lower end of pneumatic cylinder 4.

In this embodiment, a Model 350N (0196CJ2913) pneumatic spring cylinder manufactured and sold by Stabilus Corporation was used.

If desired, other types of mechanical, hydraulic or pneumatic seat height adjustment mechanisms could be used, which may require a modification of the internal diameter of the bushing 8 and the lower portion 7 of the hub 3 to accommodate the different mechanism.

Figure 4:
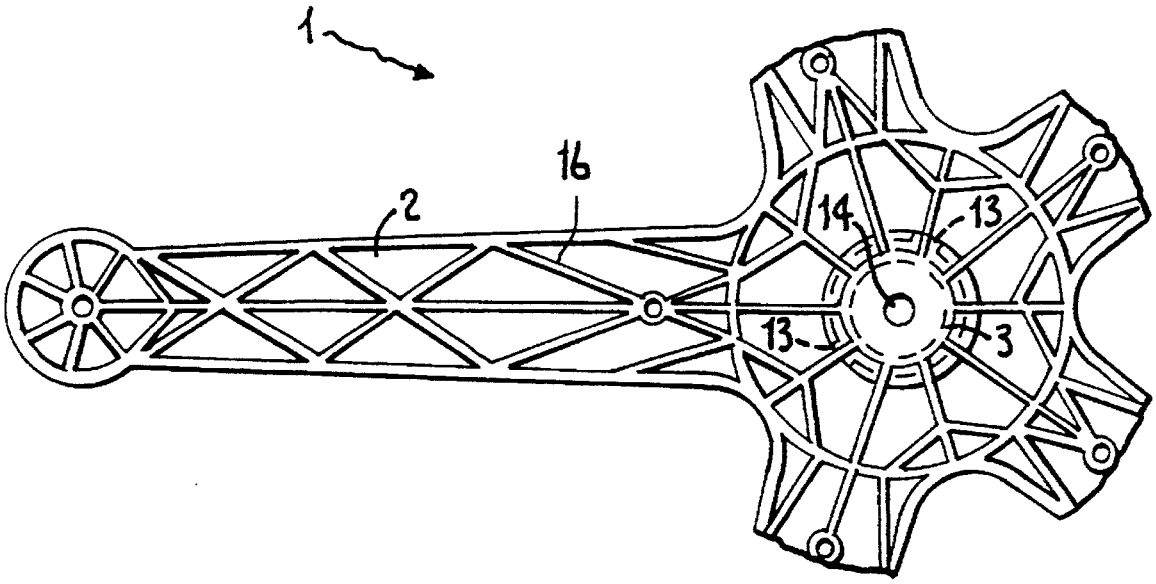
FIG. 4 is a partial bottom view of a preferred embodiment of the pedestal chair base made in accordance with this invention.

As shown in FIG. 4, the underside of the leg members 2 and the area where the leg members 2 converge and merge into the central hub 3 are comprised of plastic outer walls and a series of internal stiffening ribs 16 which combine to provide a very strong and durable, but lightweight chair base 1 which is entirely made of an injection molded structural plastic. The ends of the leg members 2 may be fitted with casters 17 or glides, as desired. If desired, the leg members 2 can be made of a structural plastic that has been colored to coordinate the chair base 1 with the color of the chair it supports.

It is understood that this embodiment is just one example of a furniture base of this invention and is provided for purposes of illustrating this invention and not for the purpose of limitation.

I claim:

1. A base for supporting a chair comprising a plurality of radially oriented leg members which converge about a central cylindrical hud, said hub and all of said leg members being formed as a single integral piece of molded plastic, said cylindrical hub having an upper portion which extends above said leg members and a lower portion that extends below said leg members wherein said leg members converge about said hub, said upper portion of said hub including a hollow cylindrical plastic bushing, each of said upper portion, said lower portion and said bushing having an internal diameter, said internal diameter of said lower portion of said hub being substantially smaller than said internal diameter of said upper portion of said hub, and said internal diameter of said bushing being substantially similar to said internal diameter of said lower portion of said hub, wherein said internal diameter of said lower portion of said hub is adapted to support a chair seat height adjustment mechanism.

2. The base of claim 1 in which the bushing is provided with a top flange adapted to fit over the upper portion of the hub and a pair of integral spring-like clips adapted to fit within mating openings at the juncture of the upper and lower portions of the hub.

3. The base of claim 2 in which the bushing is provided with external stiffening ribs.

4. The base of claim 1 in which the chair seat height adjustment mechanism is a pneumatic cylinder.

* * * * *